US005644216A

United States Patent [19]

Lopez et al.

[11] Patent Number: 5,644,216

[45] Date of Patent: Jul. 1, 1997

[54] TEMPERATURE-STABLE CURRENT SOURCE

[75] Inventors: Joaquin Lopez, Aix en Provence; Jean-Michel Coquin, Marseille, both of France

[73] Assignee: SGS-Thomson Microelectronics, S.A., Gentilly, France

[21] Appl. No.: 454,926

[22] Filed: May 31, 1995

[30] Foreign Application Priority Data

Jun. 13, 1994 [FR] France ..... 94 07407

[51] Int. Cl.[6] ..... G05F 3/16

[52] U.S. Cl. ..... 323/315; 323/907; 365/226

[58] Field of Search ..... 323/315, 316, 323/907

[56] References Cited

U.S. PATENT DOCUMENTS

| | | | |
|---|---|---|---|
| 4,031,456 | 6/1977 | Shimada et al. | 323/4 |
| 4,300,091 | 11/1981 | Schade, Jr. | 323/315 |
| 5,180,967 | 1/1993 | Yamazaki | 323/315 |
| 5,512,855 | 4/1996 | Kimura | 327/538 |

FOREIGN PATENT DOCUMENTS

| | | |
|---|---|---|
| 0052553 | 5/1982 | European Pat. Off. . |
| 2186453 | 8/1987 | European Pat. Off. . |
| 0454250 | 10/1991 | European Pat. Off. . |
| 0483913 | 5/1992 | European Pat. Off. . |
| 0531615 | 3/1993 | European Pat. Off. . |

*Primary Examiner*—Peter Wong
*Assistant Examiner*—Shawn Riley
*Attorney, Agent, or Firm*—Robert Groover; Betty Formby; Matthew Anderson

[57] ABSTRACT

In order to give the current the quality of low sensitivity to temperature, a first MOS transistor and a second MOS transistor supplied by a current mirror have their sources connected to the ground, with the drain and the gate of the first transistor being connected to the gate of the second transistor by means of a resistor. The quotient of the dimensional ratios of the transistors is equal to the coefficient of the current mirror and the transistors are doped so that the threshold of the second transistor is greater than that of the first one. Application notably to ramp generators for the programming of EEPROM cells.

16 Claims, 2 Drawing Sheets

TEMPERATURE-STABLE CURRENT SOURCE

BACKGROUND OF THE INVENTION

1. Field of the Invention

The invention lies in the field of electronic circuits using insulated-gate field-effect transistors to obtain current sources. These circuits use so-called MOS technology and are generally in the form of integrated circuits or are part of integrated circuits. The invention relates more specifically to current sources of this type that are designed to display a certain degree of immunity to temperature variations.

2. Description of the Prior Art

Current sources generally have many applications in electronics. They are used notably to make calibrated ramp signal generators. For this purpose, the current source supplies a capacitor whose voltage gives the ramp signal.

Ramp generators are used, for example, to carry out the programming or erasure of memory cells constituting electrically erasable programmable memories (EEPROMs).

A known assembly in MOS technology for making a current source consists of the use of two current mirrors respectively using p channel MOS (PMOS) transistors and n channel MOS (NMOS) transistors, the NMOS transistors having different threshold values (see the diagram of FIG. 1). It can be shown that the currents flowing in the arms of this circuit are approximately proportional to the carrier mobility of the NMOS transistors and to the square of the difference of their threshold values. The result thereof is that the currents are in fact highly dependent on the temperature because the carrier mobility as well as the square of the difference between the threshold values varies very greatly as a function of the temperature.

The problem of the temperature stabilization of electronic circuits in general is known per se but usually leads to making the circuits more complicated and to increasing their consumption.

Hence, an aim of the invention is to propose a simple and efficient approach to this problem in the case of current sources.

SUMMARY OF THE INVENTION

To this end, an object of the invention is a current source comprising a current mirror designed to give a first current proportional to a second current in a given ratio, a first insulated-gate field-effect transistor and a second insulated-gate field-effect transistor whose sources are connected to a first common potential, the drain and the gate of the first transistor being connected to the gate of the second transistor by means of a resistor, wherein:

—said second current directly supplies the channel of said second transistor,

—said first current supplies the channel of said first transistor by means of said resistor, —said first and second transistors are doped so that the conduction threshold of the second transistor is higher than that of the first transistor —and with the dimensional ratio of a transistor being defined as the ratio of the width of its gate to the length of its gate, the first and second transistors are sized so that the dimensional ratio of the first transistor is proportional to that of the second transistor in said given ratio.

This structure has the effect of imposing a difference in potential on the terminals of the resistor that is equal to the difference between the threshold values of the first and second transistors. The current is therefore proportional to this difference and no longer to its square. Furthermore, the difference in threshold values depends little on the temperature variations. The result thereof is that the current will also depend little on these variations.

Furthermore, computation shows that the difference in threshold values is approximately proportional to the absolute temperature. It is also known that the resistance of a resistor made by diffusion with low doping is also proportional to the absolute temperature. Hence, according to an additional characteristic of the invention that is especially advantageous in the case of an embodiment in the form of an integrated circuit, the resistor is made by the diffusion or implantation of impurities in the substrate of the integrated circuit with a doping that is low enough for the value of the resistor to vary linearly as a function of the temperature.

The choice of a diffused resistor with low doping does not however make it possible to obtain a compact resistor having a very high value. This means that the current flowing therein cannot be as low as might be desired. Hence, in order to compensate for this constraint, the ratio between the first current and the second current will advantageously be chosen to be greater than one.

According to one particular embodiment of the invention, there is provided a current source wherein said first and second transistors are n channel MOS transistors and wherein said current mirror is made by means of third and fourth p channel MOS transistors having their gates connected to each other and their sources connected to a second potential that is higher than said first potential, said third transistor being mounted as a diode, said third and fourth transistors being designed to respectively give said first and second currents in said given ratio.

According to another aspect, the dimensional ratio of said third transistor will be chosen so as to be proportional to that of the fourth transistor in said given ratio.

In order to provide the above assembly with a certain degree of tolerance to fluctuations in supply voltages, it is furthermore provided, according to the invention, that said current mirror has a component displaying a substantial dynamic resistance as compared with the resistance value of said resistor, said component being connected between the drain of the third transistor and the gate of the second transistor.

According to a particularly valuable embodiment, said component is a fifth n channel MOS transistor having its drain connected to the drain of said third transistor, its source connected to the gate of the second transistor and its gate connected to the drain of the second transistor.

Apart from its role of absorbing the fluctuations of supply voltages, the fifth transistor mounted in the manner indicated has the valuable property of ensuring the state of saturation of the second transistor independently of the supply voltage.

BRIEF DESCRIPTION OF THE DRAWING

Other aspects of embodiments and advantages of the invention shall appear hereinafter in the description with reference to the following figures.

MORE DETAILED DESCRIPTION

Figure 1:
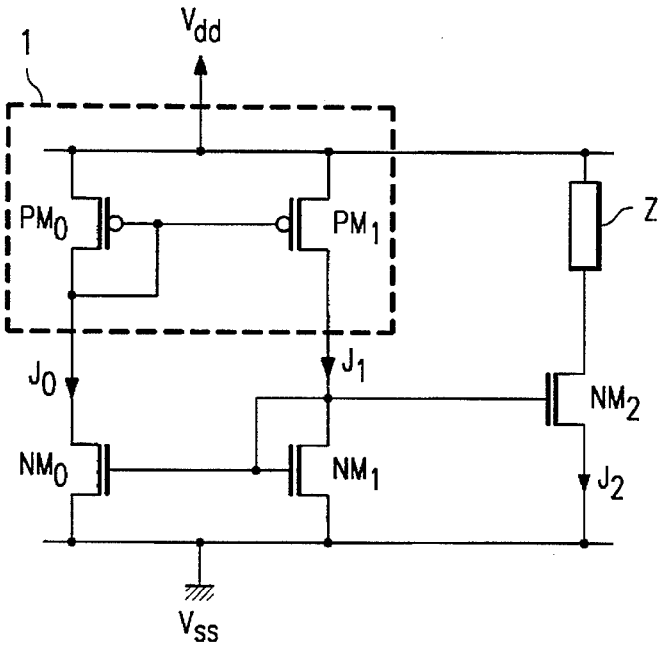
FIG. 1 shows the diagram of a current source according to the prior art.

FIG. 1 shows a known diagram of a current source. It is constituted by a current mirror 1 formed by two p channel MOS transistors PM0 and PM1 respectively giving the currents J0 and J1 to the n channel MOS transistors NM0 and NM1 whose sources are connected to a common potential Vss that may be, for example, the ground of the circuit and whose gates are connected to each other. One of the transistors NM1 is mounted as a diode and is doped so as to have a threshold higher than that of the second transistor NM0. The transistor NM0 will, for example, be a native transistor, namely a transistor whose channel has the same p type doping as the substrate, with a threshold of about 0.2 volts while the transistor NM1 is enhanced by boron implantation in the substrate so as to give it a threshold of about 0.8 volts.

To supply a load Z at constant current, it is possible to form a second current mirror by means of a fourth transistor NM2 whose source is connected to the potential Vss and whose gate is connected to the drain of the transistor NM1. The load Z is placed between the drain of the transistor NM2 and the potential Vdd greater than Vss.

The transistors of the circuit are all biased so as to work in saturated mode. The dimensional ratios of the transistors PM0 and PM1 dictate the ratio $\beta=J0/J1$ of the currents J0 and J1 flowing respectively in these transistors. Similarly, the dimensional ratios of the transistors NM1 and NM2 of the second current mirror fix the ratio J1/J2 where J2 is the current flowing in the load Z.

It can be shown that, as an initial approximation:

$J1=k(VT1-VT0)^2$ where VT0 and VT1 are respectively the threshold values of the transistors NM0 and NM1, k being a coefficient that depends on the values of carrier mobility of the transistors of the assembly.

Since these carrier mobility values as well as the term $(VT1-VT0)^2$ depend substantially on the temperature, the current that results therefrom will also be highly dependent.

Figure 2:
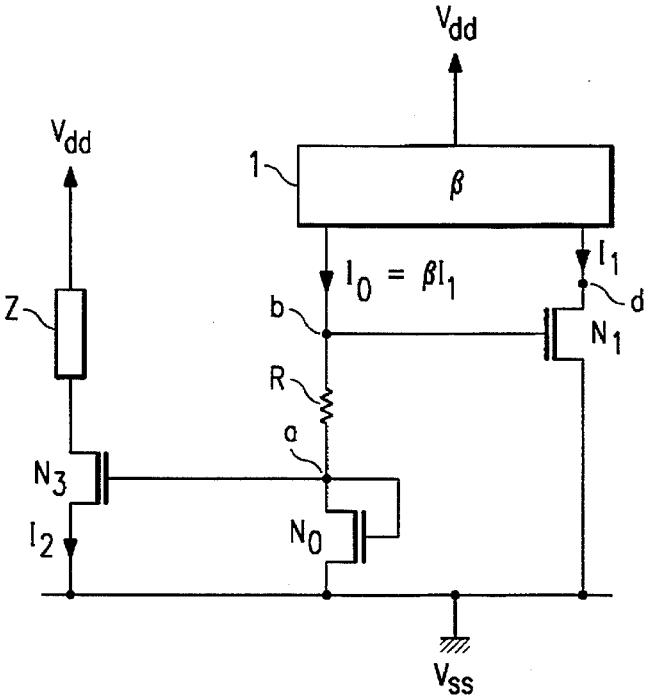
FIG. 2 shows the diagram of the current source according to the invention.

FIG. 2 shows a diagram of a current source according to the invention. The source has a current mirror 1 with a ratio $\beta$ giving the currents I0 and I1 according to the relationship $I0=\beta I1$. The current I1 supplies the drain d of an n channel MOS transistor N1 whose source is connected to the potential Vss. The current I0 supplies the drain a of another n channel MOS transistor N0 by means of a resistor R. The transistor NO is mounted as a diode and therefore has its gate connected to its drain a. The gate of the transistor N1 is connected to the connection point b of the resistor R at the current mirror 1. As in the case of the assembly of FIG. 1, the load Z is series-connected with another n channel MOS transistor N3 whose gate is connected to the drain a of the transistor N0 so as to form a current mirror.

The transistors N0 and N1 are doped differently so that the threshold VT1 of the transistor N1 is greater than the threshold VT0 of the transistor N0. The transistor N0 is, for example, a native transistor and the transistor N1 is said to be enhanced by means of an additional p type doping of the channel.

Assuming that the transistor N1 is biased in saturated mode, it is possible to write, as an initial approximation:

$I0=k0(W0/L0)(Va-VT0)^2$ $I1=k1(W1/L1)(Vb-VT1)^2$ where

—k1 and k2 depend on the mobility of the electrons and the capacitance of the gates per unit of surface area, —W0/L0 and W1/L1 are the dimensional ratios (ratio of the width to the length) of the gates of the transistors N0 and N1, —Va and Vb are the gate potentials of the transistors N0 and N1.

Since k1 and k2 are practically independent of the doping, we have k1=k2.

Since, furthermore, $I0=\beta I1$, if the transistors N0 and N1 are sized so as to have:

$$W0/L0=\alpha(W1/L1)$$

it is deduced therefrom that:

$Vb-Va=VT1-VT0=R.I0$

Thus, the voltage at the terminals of the resistor R is equal to the difference of the threshold values VT1 and VT0 of the transistors N1 and N0. The current I0 therefore depends on this difference and on the value of the resistor R but no longer depends on the values of carrier mobility.

In order to assess the dependence of the current on temperature variations, it is necessary to compute the threshold values VT1 and VT0 as well as their difference in a particular case. The threshold value VT of an NMOS transistor is given by the following equation:

$$VT=(2KT/a)ln(N/Ni)+[4\epsilon NKT.ln(N/Ni]^{1/2}\ (1/Cox)$$

where:

—K=Planck's constant

—T=absolute temperature

—q=charge of the electron

—ln=natural logarithm

—Ni=intrinsic doping

—N=doping of the substrate

—$\epsilon$=capacitance coefficient of silicon

—Cox=gate capacitance per unit of surface area.

With N=Ne for the transistor N1 and N=Nnat for the transistor N0, the following is deduced therefrom:

$$VT1-VT0=AT+BT^{1/2}$$

with:

$A=(2K/q)ln(Ne/Nnat)$ $B=(4\epsilon K)^{1/2}[[Ne.ln(Ne/Ni)]^{1/2}-[Nnat.ln\ (Nnat/ni)]^{1/2}]$ (1/Cox)

With a standard technology we will have for example:

$Ne=10^{23}/m^3$ $Nnat=10^{21}/m^3$ $Ni=1.45\ 10^{16}/m^3$ $Cox=2.7\ 10^{-3}\ F/m^2$ we then obtain:

$A=1.58\ 10^{-3}\ V/K$ $B=2.8\ 10^{-17}\ V/(K)^{1/2}$

It is observed that VT1-VT0 is practically proportional to the absolute temperature T and has little sensitivity to its variations.

The resistor R may be made of polysilicon and will therefore have the property of having little dependence on the temperature and on the variations in the parameters of the manufacturing method. However, it has the drawback of requiring a substantial surface area. Another approach consists of the use of a diffused resistor obtained by diffusion or implantation of n type impurities in the p type substrate. In the case of low doping and for a given temperature range, the value of a diffused resistor is given by the relationship:

$R=(1K/SqN.Dn)T$ with:

l=length of the resistor

S=section of the resistor

N=doping

Dn=diffusion coefficient.

It is then observed that the value of the resistor R is practically proportional to the absolute temperature T. Since the voltage applied to its terminals is itself proportional to the absolute temperature, the current I0 is practically independent of the temperature. Naturally, this result remains valid provided that the transistor N1 works in saturated mode and if the transistor N0 is conductive. This will always be the case if the supply potential Vdd is high enough with respect to the threshold voltage of these transistors and if the static impedance of the current mirror 1 is not very high.

Figure 3:
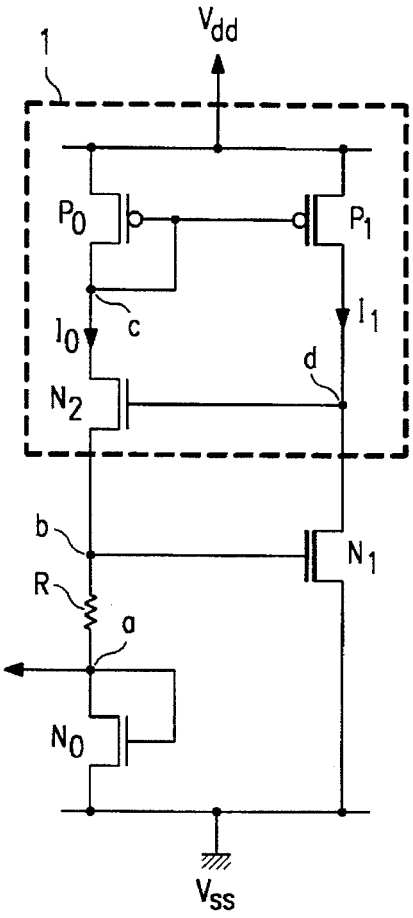
FIG. 3 shows a preferred embodiment of the invention.

The circuit of FIG. 3 gives a detailed view of a possible and particularly simple embodiment of the current mirror 1. The mirror 1 is formed by means of two p channel MOS transistors P0, P1 having their gates connected to each other and their sources connected to a supply potential Vdd that is greater than the potential Vss. The transistor P0 is mounted as a diode by means of the connection between its drain c and its gate.

The ratio of the currents I0/I1 flowing in these transistors is dictated by the quotient of their dimensional ratio. We therefore have:

$\beta=(W'0/L'0)/(W'1/L'1)$ where W'0 and W'1 are the effective gate widths respectively of the transistors P0 and P1 and L'0 and L'1 are their effective gate lengths.

In order that β may be independent of the voltages applied to the transistors, it is desirable however that the depleted zones at the ends of the gates should be negligible as compared with the lengths of the gates. This condition will be met by choosing gate lengths greater than about 4 μm.

This result will of course be obtained only on condition that the supply voltage Vdd is sufficient for the transistor P1 to work in saturated mode and for the voltage at the terminals of the transistors P0 to be greater in terms of absolute value than its threshold voltage.

In order to make the circuit less sensitive to the variations in supply voltage, there is provided a third n channel MOS transistor N2 having its drain connected to the drain c of the transistor P0, its source connected to the gate of the transistor N1 and its gate connected to the drain of the transistor N1. The transistor N2 thus arranged has the effect of providing for the operation, in saturated mode, of the transistor N1. Furthermore, if the supply potential Vdd is high enough as compared with the drops in voltage of the drain-source paths of the transistors, the transistors N2 and P1 are biased in saturated mode. The transistor N2 in saturated mode then has a substantial dynamic impedance which has the effect of absorbing the variations of the supply voltage. The circuit is therefore stable both in temperature and in terms of supply voltage.

Advantageously, a transistor with low doping will be chosen for N2, for example a native transistor, so that it has a low threshold voltage thus making it easier to bias it in saturated mode.

In practice, the condition of saturation of all the transistors is that the supply voltage should be greater than the sum of the threshold voltages of the transistors that form each arm of the assembly.

Furthermore, the transistors P0, P1 as well as N2 will be preferably sized so as to have the lowest possible static impedance in order to enable efficient operation for low values of supply voltage.

The precise choice of the parameters of the circuit will depend of course on the application envisaged. It must be noted, however, that the choice of a diffused resistor that is compact and has low doping does not make it possible to obtain a very low current I0 (for example a current of 30 μA for R=20 kΩ with VT1=0.8 volts and VT0=0.2 volts). It will therefore be appropriate to choose β as being greater than 1 (for example equal to 10) so as to reduce the consumption in the right-hand arm of the assembly.

Figure 4:
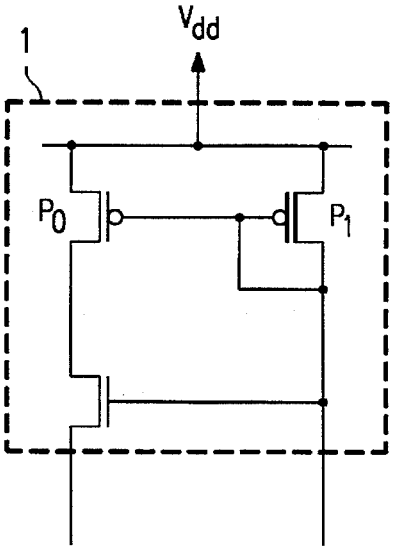
FIG. 4 shows a variant of the diagram of FIG. 3.
Figure 5:
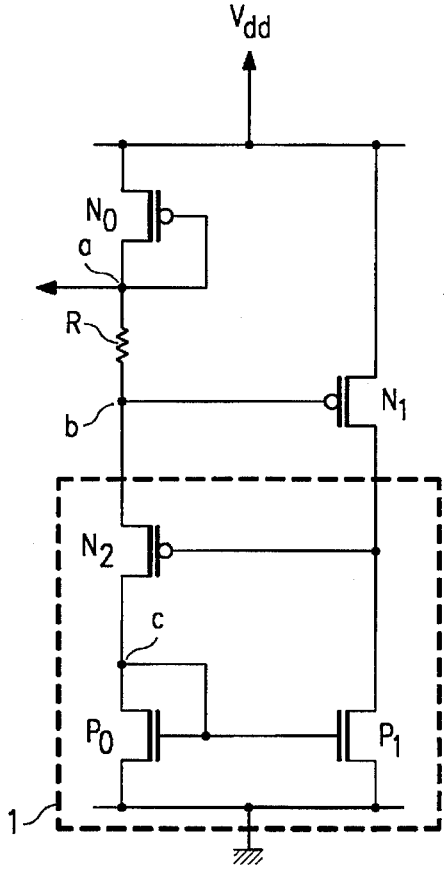
FIG. 5 shows a dual assembly of the diagram of FIG. 3.

The invention cannot be limited to the particular embodiment that has just been described. Many variants are indeed within the scope of those skilled in the art. Thus, as shown in FIG. 4, it is possible to mount the transistor P1 as a diode instead of the transistor P0. Similarly, the circuit of FIG. 3 can be converted into its dual assembly as shown in FIG. 5. Finally, the transistor N2 could be replaced by a component of another type having high dynamic impedance.

What is claimed is:

1. A current source comprising:

a current mirror designed to give a first current proportional to a second current in a given ratio; and a first insulated-gate field-effect transistor and a second insulated-gate field-effect transistor whose sources are connected to a first common potential, the drain and the gate of the first transistor being connected to the gate of the second transistor by means of a resistor;

wherein said second current directly supplies the channel of said second transistor, said first current supplies the channel of said first transistor by means of said resistor, said first and second transistors are doped so that the conduction threshold of the second transistor is higher than that of the first transistor, and the dimensional ratio of each of said first and second transistors being defined as the ratio of the width of its gate to the length of its gate, said first and second transistors being sized so that the dimensional ratio of said first transistor is proportional to that of said second transistor in said given ratio;

wherein said current mirror has a component connected to display a substantial dynamic resistance as compared with the resistance value of said resistor, said component being a third transistor which is a native transistor.

2. The current source of claim 1, wherein said third transistor is a n channel MOS transistor having its drain connected to the drain of said fourth transistor, its source connected to the gate of said second transistor and its gate connected to the drain of said second transistor.

3. The current source of claim 1, wherein the current source forms part of an integrated circuit, said integrated circuit having a substrate which includes at least one monolithic body of semiconductor material; and wherein said resistor is made by the diffusion or implantation of impurities in said substrate of said integrated circuit with a doping that is low enough for the value of said resistor to vary linearly as a function of the temperature.

4. The current source of claim 3, wherein said given ratio is greater than one.

5. The current source of claim 1, wherein said first and second transistors are n channel MOS transistors and wherein said current mirror comprises fourth and fifth p channel MOS transistors having their gates connected to each other and their sources connected to a second potential that is higher than said first potential, said fourth transistor being mounted as a diode, said fourth and fifth transistors being designed to respectively give said first and second currents in said given ratio.

6. The current source of claim 5, wherein the dimensional ratio of said fourth transistor is proportional to that of said fifth transistor in said given ratio.

7. The current source of claim 5, wherein each of said fourth and fifth transistors has a gate length equal to or greater than 4 μm.

8. A current source, comprising:

a current mirror designed to give a first current proportional to a second current in a given ratio; and a first insulated-gate field-effect transistor and a second insulated-gate field-effect transistor whose sources are connected to a first common potential, the drain and the gate of the first transistor being connected to the gate of the second transistor by means of a diffused resistor;

wherein said second current directly supplies the channel of said second transistor, said first current supplies the channel of said first transistor by means of said diffused resistor, said first and second transistors are doped so that the conduction threshold of the second transistor is higher than that of the first transistor, and the dimensional ratio of each of said first and second transistors being defined as the ratio of the width of its gate to the length of its gate, said first and second transistors being sized so that the dimensional ratio of said first transistor is proportional to that of said second transistor in said given ratio;

wherein said current mirror comprises third and fourth PMOS transistors having their gates connected together and their sources connected to a second potential that is higher than said first potential, said third transistor being mounted as a diode, said third and fourth transistors being designed to respectively give said first and second currents in said given ratio;

wherein each of said third and fourth transistors has a gate length equal to or greater than 4 μm.

9. The current source of claim 8, wherein the current source forms part of an integrated circuit, said integrated circuit having a substrate which includes at least one monolithic body of semiconductor material; and wherein said resistor is made by the diffusion or implantation of impurities in said substrate of said integrated circuit with a doping that is low enough for the value of said resistor to vary linearly as a function of the temperature.

10. The current source of claim 8, wherein said given ratio is greater than one.

11. The current source of claim 8, wherein said first and second transistors are n channel MOS transistors.

12. The current source of claim 8, wherein said first transistor is a native transistor.

13. The current source of claim 8, wherein the dimensional ratio of said third transistor is proportional to that of fourth transistor in said given ratio.

14. The current source of claim 8, wherein said current mirror has a component displaying a substantial dynamic resistance as compared with the resistance value of said resistor, said component being connected between the drain of said third transistor and the gate of said second transistor.

15. The current source of claim 12, wherein said component is a fifth n channel MOS transistor having its drain connected to the drain of said third transistor, its source connected to the gate of said second transistor and its gate connected to the drain of said second transistor.

16. The current source of claim 13, wherein said fifth transistor is designed to have a threshold value lower than that of said second transistor.

* * * * *